US008342094B2

(12) United States Patent
Marya et al.

(10) Patent No.: US 8,342,094 B2
(45) Date of Patent: Jan. 1, 2013

(54) DISSOLVABLE MATERIAL APPLICATION IN PERFORATING

(75) Inventors: Manuel P. Marya, Sugar Land, TX (US); Wenbo Yang, Sugar Land, TX (US); Lawrence A. Behrmann, Houston, TX (US); Steven W. Henderson, Katy, TX (US); Robert Ference, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 274 days.

(21) Appl. No.: 12/603,996

(22) Filed: Oct. 22, 2009

(65) Prior Publication Data

US 2011/0094406 A1 Apr. 28, 2011

(51) Int. Cl.
*F42B 1/02* (2006.01)
*E21B 43/117* (2006.01)

(52) U.S. Cl. ..... 102/306; 102/305; 102/313; 89/1.15; 166/297; 175/4.6

(58) Field of Classification Search ..... 102/305; 89/1.15; 166/297, 376; 175/4.6
See application file for complete search history.

(56) References Cited

U.S. PATENT DOCUMENTS

| | | | | |
|---|---|---|---|---|
| 2,927,534 | A * | 3/1960 | Le Bus | 175/4.53 |
| 3,054,938 | A * | 9/1962 | Meddick | 102/310 |
| 3,674,091 | A * | 7/1972 | Kisling, III | 166/374 |
| 5,103,911 | A * | 4/1992 | Heijnen | 166/297 |
| 5,477,785 | A | 12/1995 | Dieman, Jr. et al. | |
| 6,220,350 | B1 | 4/2001 | Brothers et al. | |
| 6,220,355 | B1 * | 4/2001 | French | 166/297 |
| 6,241,021 | B1 * | 6/2001 | Bowling | 166/380 |
| 6,289,991 | B1 * | 9/2001 | French | 166/382 |
| 6,482,866 | B1 | 11/2002 | Dahayanake | |
| 6,703,352 | B2 | 3/2004 | Dahayanake | |
| 6,831,044 | B2 * | 12/2004 | Constien | 507/201 |
| 6,877,562 | B2 * | 4/2005 | Bourne | 166/297 |
| 6,983,698 | B1 * | 1/2006 | Walters et al. | 102/307 |
| 7,049,272 | B2 * | 5/2006 | Sinclair et al. | 507/230 |
| 7,059,410 | B2 * | 6/2006 | Bousche et al. | 166/296 |
| 7,073,448 | B2 * | 7/2006 | Bell | 102/306 |
| 7,238,648 | B2 | 7/2007 | Dahayanake | |
| 7,287,592 | B2 * | 10/2007 | Surjaatmadja et al. | 166/308.1 |
| 7,360,593 | B2 * | 4/2008 | Constien | 166/227 |
| 7,581,498 | B2 * | 9/2009 | Hetz et al. | 102/306 |
| 7,721,649 | B2 * | 5/2010 | Hetz et al. | 102/307 |
| 7,726,406 | B2 * | 6/2010 | Xu | 166/376 |
| 7,775,279 | B2 | 8/2010 | Marya | |

(Continued)

FOREIGN PATENT DOCUMENTS

EP 993334 A1 4/2000

(Continued)

*Primary Examiner* — Michael David
(74) *Attorney, Agent, or Firm* — Chad Sullivan; Rodney Warfford; Matt Abrell

(57) ABSTRACT

A shaped charge includes a charge case; a liner; an explosive retained between the charge case and the liner; and a primer core disposed in a hole in the charge case and in contact with the explosive, wherein at least one of the case, the liner, the primer core, and the explosive comprising a material soluble in a selected fluid. A perforation system includes a perforation gun, comprising a gun housing that includes a safety valve or a firing valve, wherein the safety valve or the firing valve comprises a material soluble in a selected fluid.

19 Claims, 8 Drawing Sheets

U.S. PATENT DOCUMENTS

| | | | | |
|---|---|---|---|---|
| 7,874,365 | B2 * | 1/2011 | East et al. | 166/305.1 |
| 7,909,115 | B2 | 3/2011 | Grove | |
| 7,913,758 | B2 * | 3/2011 | Wheller et al. | 166/259 |
| 7,913,761 | B2 * | 3/2011 | Pratt et al. | 166/297 |
| 7,987,911 | B2 * | 8/2011 | Rhodes et al. | 166/297 |
| 2001/0035302 | A1 * | 11/2001 | Desai et al. | 175/61 |
| 2004/0060734 | A1 * | 4/2004 | Bourne | 175/4.6 |
| 2007/0107908 | A1 | 5/2007 | Vaidya | |
| 2007/0181224 | A1 | 8/2007 | Marya | |
| 2008/0066923 | A1 * | 3/2008 | Xu | 166/376 |
| 2008/0105438 | A1 | 5/2008 | Jordan | |
| 2008/0282924 | A1 * | 11/2008 | Saenger et al. | 102/306 |
| 2009/0050321 | A1 * | 2/2009 | Rhodes et al. | 166/297 |
| 2009/0071361 | A1 * | 3/2009 | Hetz et al. | 102/306 |
| 2009/0114382 | A1 | 5/2009 | Grove | |
| 2009/0151949 | A1 | 6/2009 | Marya | |
| 2009/0211759 | A1 * | 8/2009 | East et al. | 166/297 |
| 2010/0000397 | A1 * | 1/2010 | Pratt et al. | 89/1.15 |
| 2011/0094406 | A1 | 4/2011 | Marya | |
| 2011/0155013 | A1 * | 6/2011 | Boyer et al. | 102/307 |

FOREIGN PATENT DOCUMENTS

| | | | |
|---|---|---|---|
| EP | 1323888 | A1 | 7/2003 |
| EP | 993334 | B1 | 8/2003 |
| EP | 1323888 | B1 | 1/2006 |
| GB | 677824 | A | 8/1952 |
| GB | 2432377 | A | 5/2007 |
| GB | 2435046 | A | 8/2007 |
| WO | 0206855 | A2 | 1/2002 |
| WO | 02006855 | A3 | 9/2002 |
| WO | 2009064662 | A1 | 5/2009 |
| WO | 2011049678 | A2 | 4/2011 |
| WO | 2011049678 | A3 | 6/2011 |

* cited by examiner

DISSOLVABLE MATERIAL APPLICATION IN PERFORATING

BACKGROUND OF INVENTION

1. Field of the Invention

The invention relates generally to apparatus and methods for perforation in a wellbore.

2. Background Art

After drilling oil wells are typically protected with steel casing that is secured to the wellbore with cement. In order to establish communication between oil/gas formations and the cased well, perforation guns carrying shaped charges are used. These shaped charges contain explosives. When the explosives are fired, they produce high pressure and high temperature. As a result, the shaped charge liners are shot out as jets that can penetrate the casing and the nearby formation.

There are two basic types of shaped charges for perforating applications, one type is big hole charges which can make large holes on the casing and relatively shallow penetration in the formation rock. Such shaped charges are typically used when big holes or big area of flow are needed, such as in sand control applications. The other type is deep-penetrating charges which can make relatively small holes on the well casing, but they can penetrate deep into the formation rock. The deep-penetrating liner jets can shoot through the damaged zones from drilling and significantly enhance the well productivity. The deep-penetrating charges are typically used in natural completion applications.

In addition to the two basic types of shaped charges described above, there are also encapsulated shaped charges, which are exposed to wellbore fluids directly and, therefore, they are sealed individually with a cap. The encapsulated shaped charges produce more debris than the same size charges carried by a hollow gun, although the encapsulated shaped charges do make bigger holes on the casing and deeper penetration into the formation rock, as compared to the non-encapsulated types.

In addition to different types of shaped charges, the dynamic pressure generated during gun detonation has also proved to be critical for well productivity. Proper manipulation of the dynamic pressure can significantly enhance well productivity. For example, by using reactive material in the shaped charge cases, the explosive pellets, and/or the liners, the heat generated from these reactive materials during detonation can have an impact on the wellbore pressure. In addition, the charge performance could also be increased by putting more of the energy into the shaped charge jets.

After firing, debris from the shaped charges and guns will be left inside the guns, wellbore, and/or formations. For example, the debris from the shaped charge jets may be left in the tunnels that were generated by the jets. This debris can clog the pores and reduce the productivity of the well, leading to big loss.

To avoid some of the problems associated with shaped charge debris, various shaped charge designs have been proposed. For example, there are charges designed to reduce the shaped charge case debris, e.g., OrientX™ charge, the 3 on a plane packing design of the big hole charges, e.g., PF4621, 6618, 7018, etc. Similarly, other designs are to reduce liner debris, e.g., powdered-metal liners, dual layer metal (zinc and copper) liners for PowerFlow™ charges. In addition, underbalanced perforating system such as PURE™ is widely used to manipulate the wellbore dynamic pressure to clean the perforating tunnels.

Even though these prior art methods are effective in reducing problems associated with shaped charge debris, there remains a need for ways to avoid or minimize debris-caused problems after perforation.

SUMMARY OF INVENTION

One aspect of the invention relates to shaped charges. A shaped charge in accordance with one embodiment of the invention includes a charge case; a liner; an explosive retained between the charge case and the liner; and a primer core disposed in a hole in the charge case and in contact with the explosive, wherein at least one of the case, the liner, the primer core, and the explosive comprising a material soluble in a selected fluid.

Another aspect of the invention relates to systems for perforating a formation. A system in accordance with one embodiment of the invention includes a perforation gun, comprising a gun housing that includes a safety valve or a firing valve, wherein the safety valve or the firing valve comprises a material soluble in a selected fluid.

Another aspect of the invention relates to methods for perforating a formation. A method in accordance with one embodiment of the invention includes lowering a perforation gun into a wellbore; detonating at least one shaped charge in the perforation gun, wherein the shaped charge comprising: an charge case, an liner, an explosive retained between the charge case and the liner; and a primer core disposed in a hole in the charge case and in contact with the explosive, wherein at least one of the case, the liner, the primer core, and the explosive comprising a material soluble in a selected fluid.

Another aspect of the invention relates to methods for perforating a formation. A method in accordance with one embodiment of the invention includes lowering a perforation gun into a wellbore, wherein the perforation gun comprises a gun housing that includes a safety valve or a firing valve, wherein the safety valve or the firing valve comprises the material soluble in the selected fluid; exposing the perforation gun to the selected fluid; allowing the safety valve or the firing valve to dissolve; establishing a pressure communication between the gun housing and the wellbore; and actuating the perforation gun.

Other aspects and advantages of the invention will be apparent from the following description and the appended claims.

DETAILED DESCRIPTION

Embodiments of the invention relate to use of dissolvable materials in shaped charges. These dissolvable materials may be used in the shaped charge cases, liners, caps, explosive pellet, and/or perforation gun strings. With proper designs of the dissolvable materials on the shaped charges and the perforation gun string components, the debris may be eliminated or minimized. As a result, perforation tunnels thus generated may be clean, leading to increased well performance. In addition, well completion and production will become more economical, and the gun strings may be properly fired minimizing safety hazards.

In accordance with embodiments of the invention, by proper applications and choice of dissolvable materials and designs, the debris may be minimized or eliminated inside the perforation guns, the wellbores, and/or the perforating tunnels. Furthermore, the hole sizes on the casings may be bigger, the penetration into the formation rock may be deeper, and the wellbore dynamic pressure may be manipulated. Accordingly, well productivity may be significantly increased and well completion engineering operation may be simplified, e.g., no debris cleaning trip, no damaged packer, no clogged choke, etc.

Figure 1:
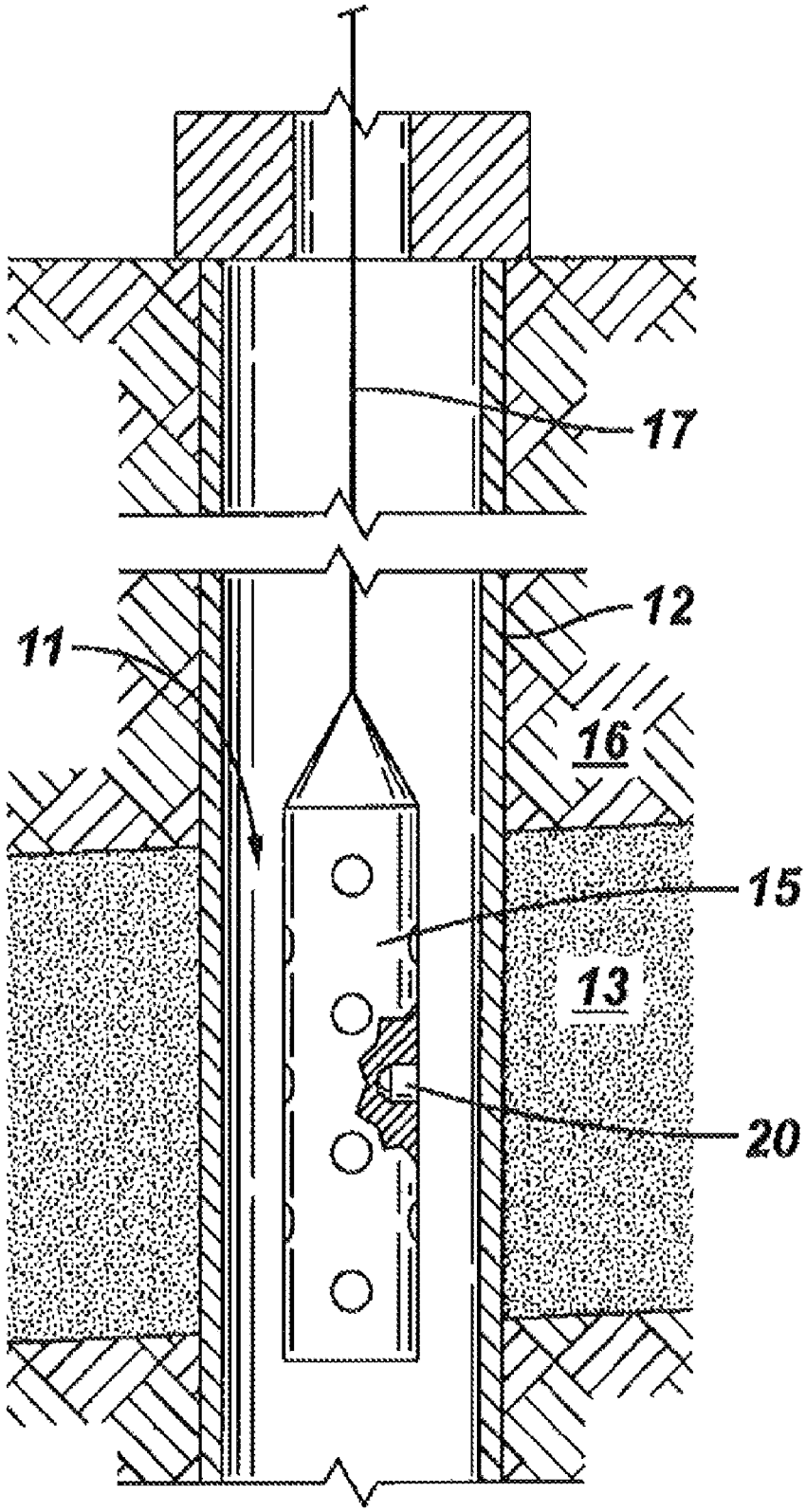
FIG. 1 shows a perforation gun disposed in a wellbore in a perforation operation.

Well perforation is typically performed after a well has been drilled and cased. Perforation is accomplished with perforation guns lowered into the wellbore. FIG. 1 shows that a perforation gun 15 lowered in a well 11 with a casing 12 cemented to the well 11 in order to maintain well integrity. After the casing 12 has been cemented in the well 11, one or more sections of the casing 12 adjacent to the formation zones of interest, e.g., target well zone 13, may be perforated to allow fluids from the formation to flow into the well for production to the surface or to allow injection fluids to be injected into the formation zones. To perforate a casing section and a formation zone, a perforation gun string may be lowered into the well 11 to a desired depth, e.g., at target zone 13, and one or more perforation guns 15 are fired to create openings in the casing and to extend perforations into the surrounding formation 16. Production fluids in the perforated formation can then flow through the perforations and the casing openings into the wellbore.

Typically, perforation guns 15, which include gun carriers and shaped charges 20 mounted on or in the gun carriers, are lowered in a wellbore to the desired formation intervals on a line or tubing 17, e.g., wireline, e-line, slickline, coiled tubing, and so forth. The shaped charges 20 carried in a perforation gun may be phased to fire in multiple directions around the circumference of the wellbore. Alternatively, the shaped charges 20 may be aligned in a straight line. When fired, the shaped charges 20 create perforating jets that form holes in the surrounding casing and extend perforation tunnels in the surrounding formation.

Figure 2:
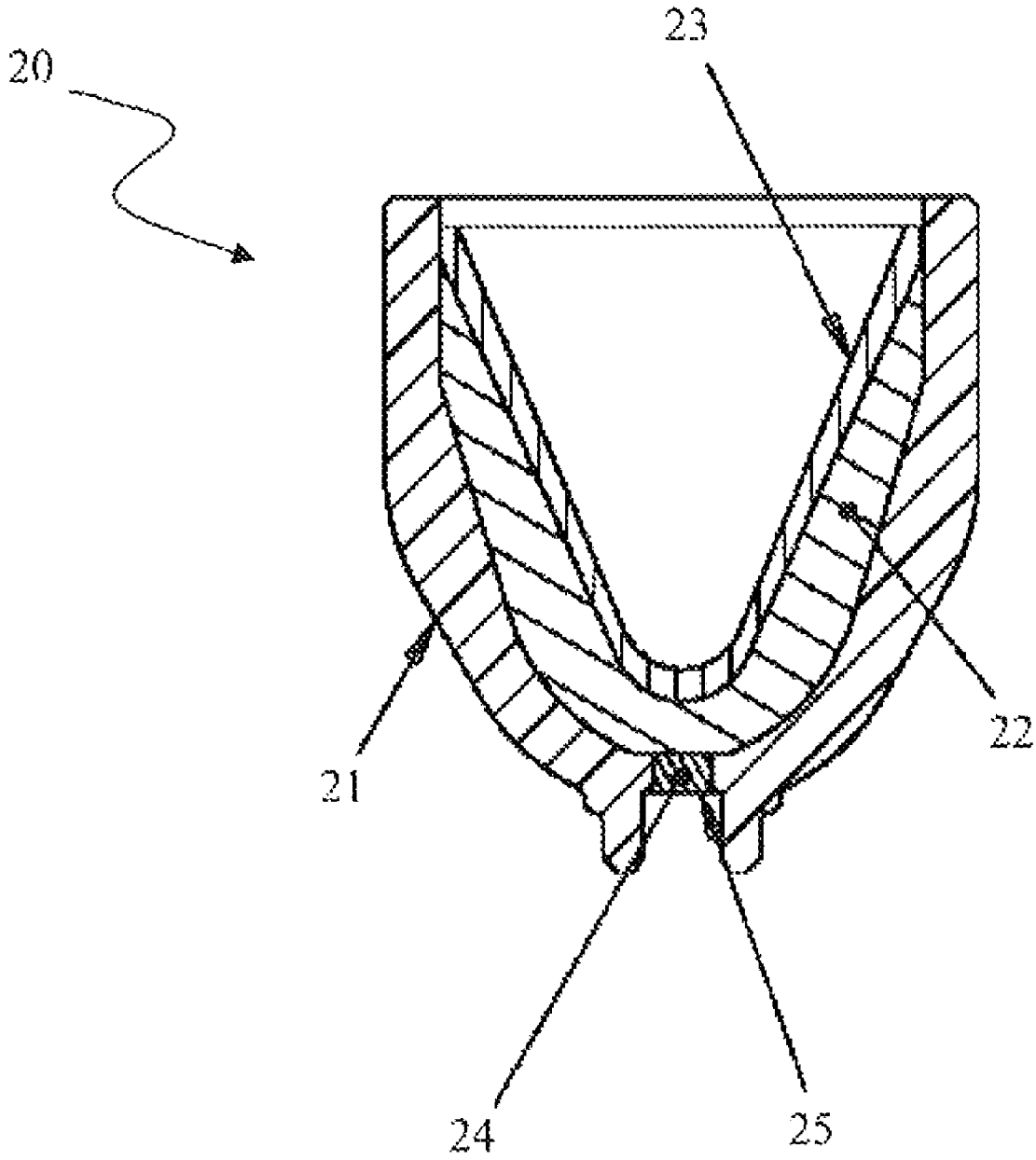
FIG. 2 shows a typical shaped charge, which includes case, explosive pellet, and liner.

FIG. 2 shows a typical shaped charge 20 in accordance with embodiments of the present invention. For example, the shaped charge 20 may include a charge case 21 that acts as a containment vessel designed to hold the detonation force of the detonating explosion long enough for a perforating jet to form. Materials for making the charge case 21 may include steel or other sturdy metals. The main explosive charge (explosive) 22 may be contained inside the charge case 21 and may be arranged between the inner wall of the charge case 21 and a inner liner 23. A primer column 24 (or other ballistic transfer element) is a sensitive area that provides the detonating link between the main explosive charge 22 and a detonating cord 25, which is attached to an end of the shaped charge 20. Examples of explosives 22 used in the various explosive components (e.g., charges, detonating cord, and boosters) include, but not limited to, RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

Figure 3:
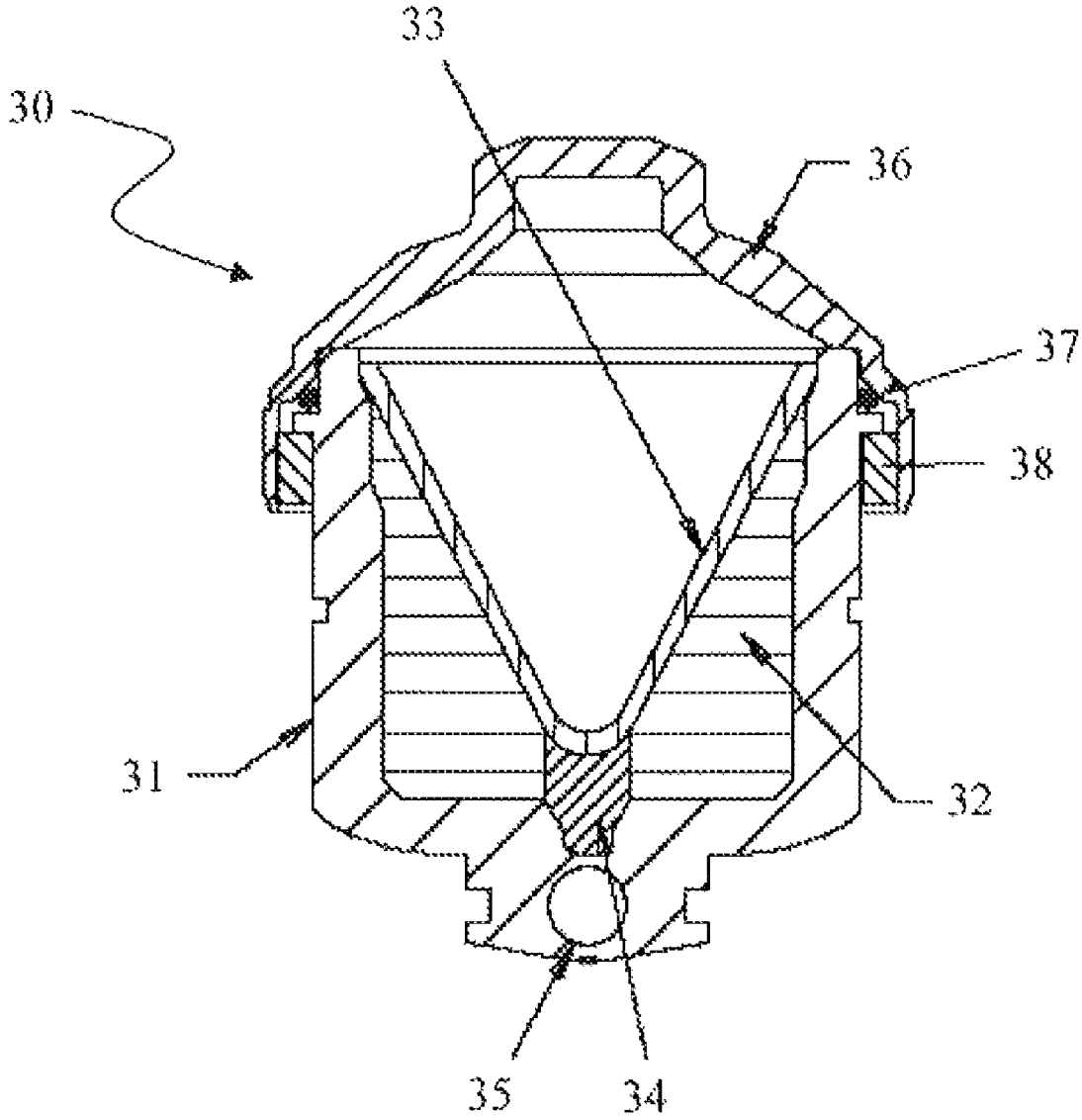
FIG. 3 shows an encapsulated charge, which has added cap, O-ring seal, and a crimping ring in addition to the components of a regular charge.

As noted above, shaped charges include encapsulated type. FIG. 3 shows a typical encapsulated shaped charge 30 in accordance with embodiments of the present invention. The encapsulated shaped charge 30 includes a case (a charge case) 31 that acts as a containment vessel designed to hold the detonation force of the detonating explosion long enough for a perforating jet to form. Materials for making the charge case 31 may include steel or other sturdy metals. The cap 36 may be made of metal. The main explosive charge (explosive) 32 may be contained inside the charge case 31 and may be arranged between the inner wall of the charge case and a inner liner 33. A primer column 34 (or other ballistic transfer element) is a sensitive area that provides the detonating link between the main explosive charge 32 and a detonating cord 35, which is attached to an end of the shaped charge. In addition, the encapsulated charge may include O-ring seals 37 and crimping ring seals 38. Examples of explosives 32 used in the various explosive components (e.g., charges, detonating cord, and boosters) include, but not limited to, RDX, HMX, TATB, HNS, and others.

To detonate a shaped charge, a detonation wave traveling through the detonating cord 25 or 35 initiates the primer column 24 or 34 when the detonation wave passes by, which in turn initiates detonation of the main explosive charge 22 or 32 to create a detonation wave that sweeps through the shaped charge. The liner 23 or 33 collapse under the detonation force of the main explosive charge.

Figure 4:
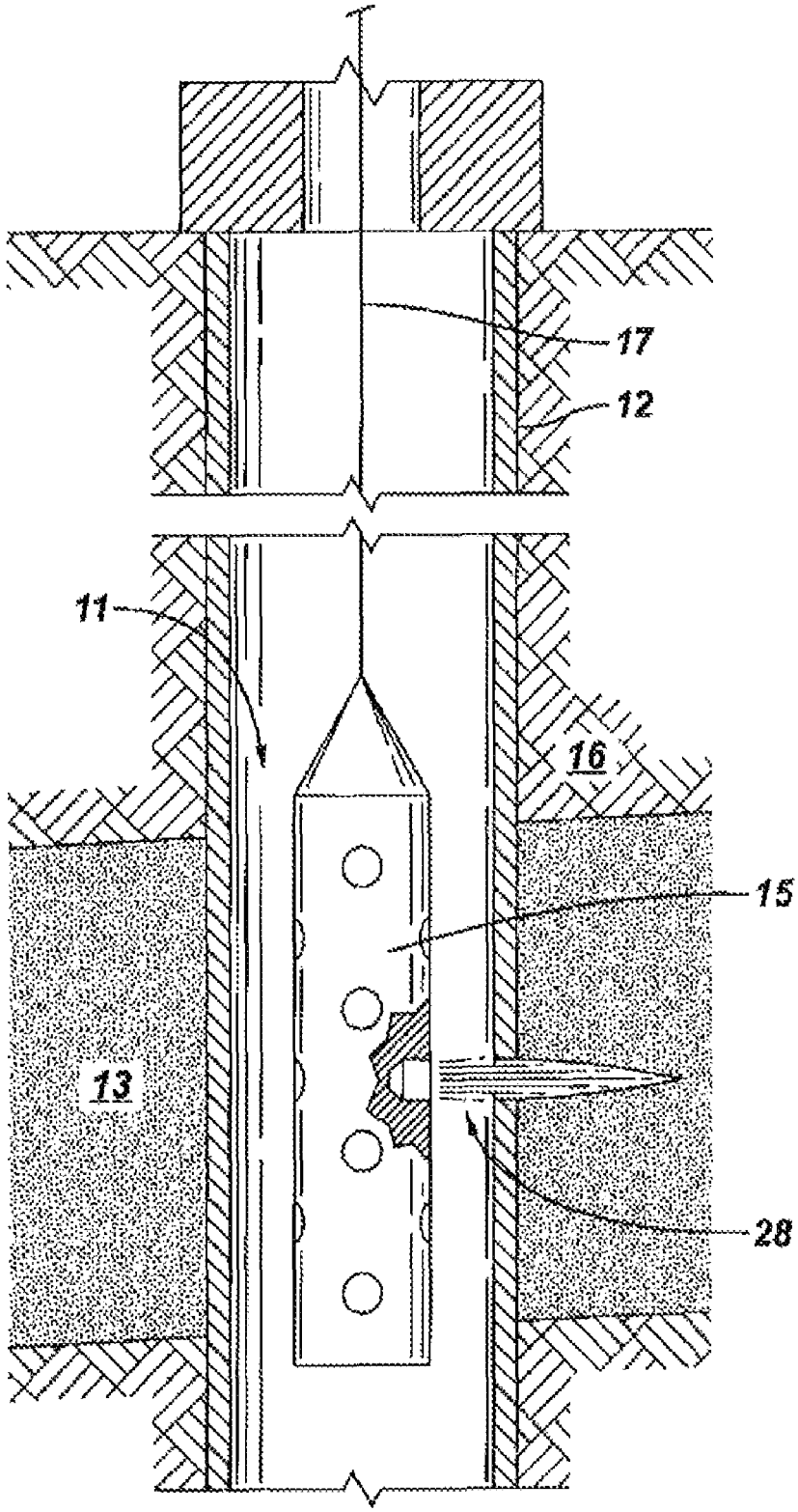
FIG. 4 shows a perforation being made with a charge in accordance with embodiments of the invention.
Figure 5:
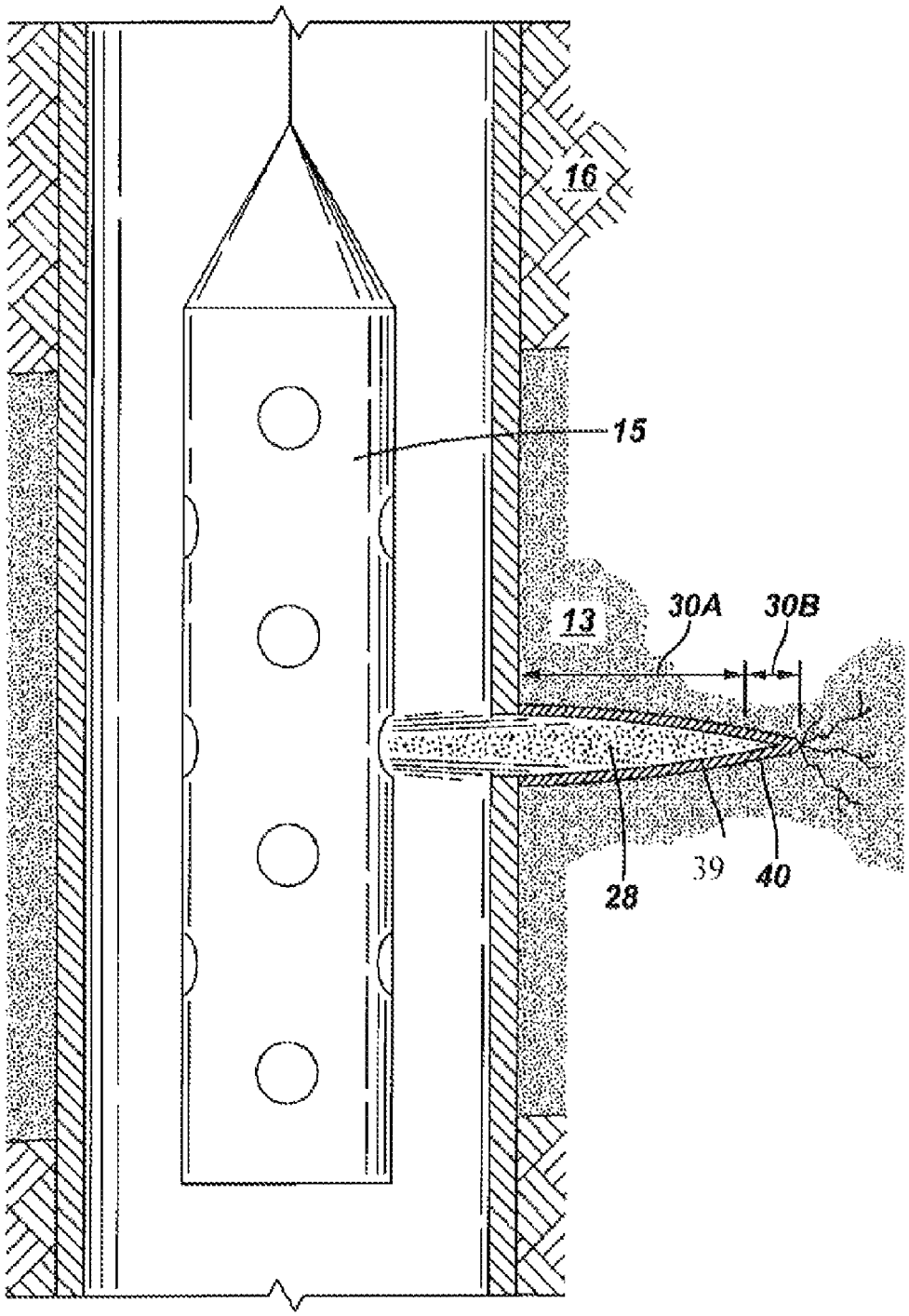
FIG. 5 shows a perforation and a tunnel made with a charge in accordance with embodiments of the invention.

Referring to FIGS. 4 and 5, the materials from the collapsed liner 23 or 33 form a perforating jet 28 that shoots from the shaped charge and penetrates the casing 12 and the underlying formation zone 13 to form a perforated tunnel (or perforation tunnel) 40. On the surface of the perforated tunnel 40, a layer of liner residue 39 may be deposited. The liner residue 39 may remain in the tunnel region 30A or the tip region 30B. Liner residue in the perforation tunnel is detrimental to injectivity and productivity. Similarly, other parts of the perforation guns, such as gun strings, shaped charge cases, etc., if not removed, will also hinder the completion and production operations of the wells.

To reduce or avoid problems resulted from perforation debris or other residual parts from the perforation guns, embodiments of the present invention may use dissolvable materials for all or parts of the perforation guns, including shaped charges (cases, liners or caps for encapsulated shaped charges) or gun strings. Such dissolvable materials may be selected such that they will dissolve in wellbore fluids after detonation, thereby leaving little or no solid debris.

"Dissolvable material" means that the material can in a selected fluid, such as fluids added to or found in the wellbore or formation, such as oil, gas, drilling fluids, or specifically formulated fluids. The term "dissolvable" is understood to encompass the terms degradable and disintegrable. Likewise, the terms "dissolved" and "dissolution" are interpreted to include "degraded" and "disintegrated," and "degradation" and "disintegration," respectively.

The dissolvable materials may be any materials known to persons of ordinary skill in the art that can be dissolved, degraded, or disintegrated within a desirable period of time at a selected temperature in a selected fluid, such as hydrocarbons, water, water-based drilling fluids, hydrocarbon-based drilling fluids, a specific solution, or gas. For example, suitable dissolvable materials may include synthetic or natural materials that can dissolve in hydrocarbons, such as plastics, polymers, or elastomers. Examples of polymers may include polyolefin (e.g., polyethylene) polymers, paraffin waxes, polyalkylene oxides (e.g., polyethylene oxides), and polyalkylene glycols (e.g., polyethylene glycols). Other dissolvable materials may be metals or alloys that can dissolve in a specific solvent. Examples of dissolvable metals or alloys may include zinc, titanium, aluminum, or alloys of these metals, which are dissolvable or degradable by acidic or neutral aqueous solutions or water.

The dissolvable materials may also include biodegradable polymers, for example, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material.

In selecting the rate of dissolution of the dissolvable materials, generally the rate is dependent on multiple factors, such as the types of the materials, the types of the fluids, the environmental factors (pressure and temperatures). For polymers, the molecular weights of the polymers are known to affect their dissolution rates. Acceptable dissolution rates, for example, may be achieved with a molecular weight range of 100,000 to 7,0000,000, preferably 100,000 to 1,0000,000. Thus, dissolution rates for a temperature range of 50° C. to 250° C. can be designed with the appropriate molecular weight or mixture of molecular weights.

The dissolvable materials may dissolve, degrade, or disintegrate over a period of time ranging from 1 hour to 240 hours, preferably from 1 to 48 hours, and more preferably from 1 to 24 hours, and over a temperature range from about 50° C. to 250° C., preferably from 100 to 250° C., more preferably from 150 to 250° C. Additionally, water or some other chemicals could be used alone or in combination to dissolve the dissolvable materials. Other fluids that may be used to dissolve the dissolvable materials include alcohols, mutual solvents, and fuel oils such as diesel.

Other dissolvable materials may include powdered metals, e.g., iron, magnesium, zinc, and aluminum, and any alloy or combination thereof. In these cases, acids may be used to dissolve any shaped charge residues in acidizing operations. Such acids include, but not limited to, hydrochloric acid, hydrofluoric acid, acetic acid, and formic acid.

For example, in accordance with embodiments of the present invention, the shaped charges (encapsulated charges or other explosive charges) may include a liner fabricated from a material that is dissolvable in the presence of a dissolving fluid, e.g., hydrocarbons, water, an acid, an injection fluid, a fracturing fluid, or a completions fluid. Any residue form such liner materials remained in the perforation tunnel would be dissolved in the dissolving fluids and is no longer detrimental to the perforation tunnels.

The dissolvable materials may be used alone or in combination with other materials, which may be dissolvable or not dissolvable. For example, in some situations, it might be desirable to alter the density of the dissolvable materials. For example, the ability to penetrate casings and formation by a perforation jet is a function of the density of the perforation jet. The density of the perforation jet in turn depends on the density of the liner material. Therefore, a heavy metal power, such as tungsten (W) powder, may be added to the liner to increase its penetration ability.

Figure 6:
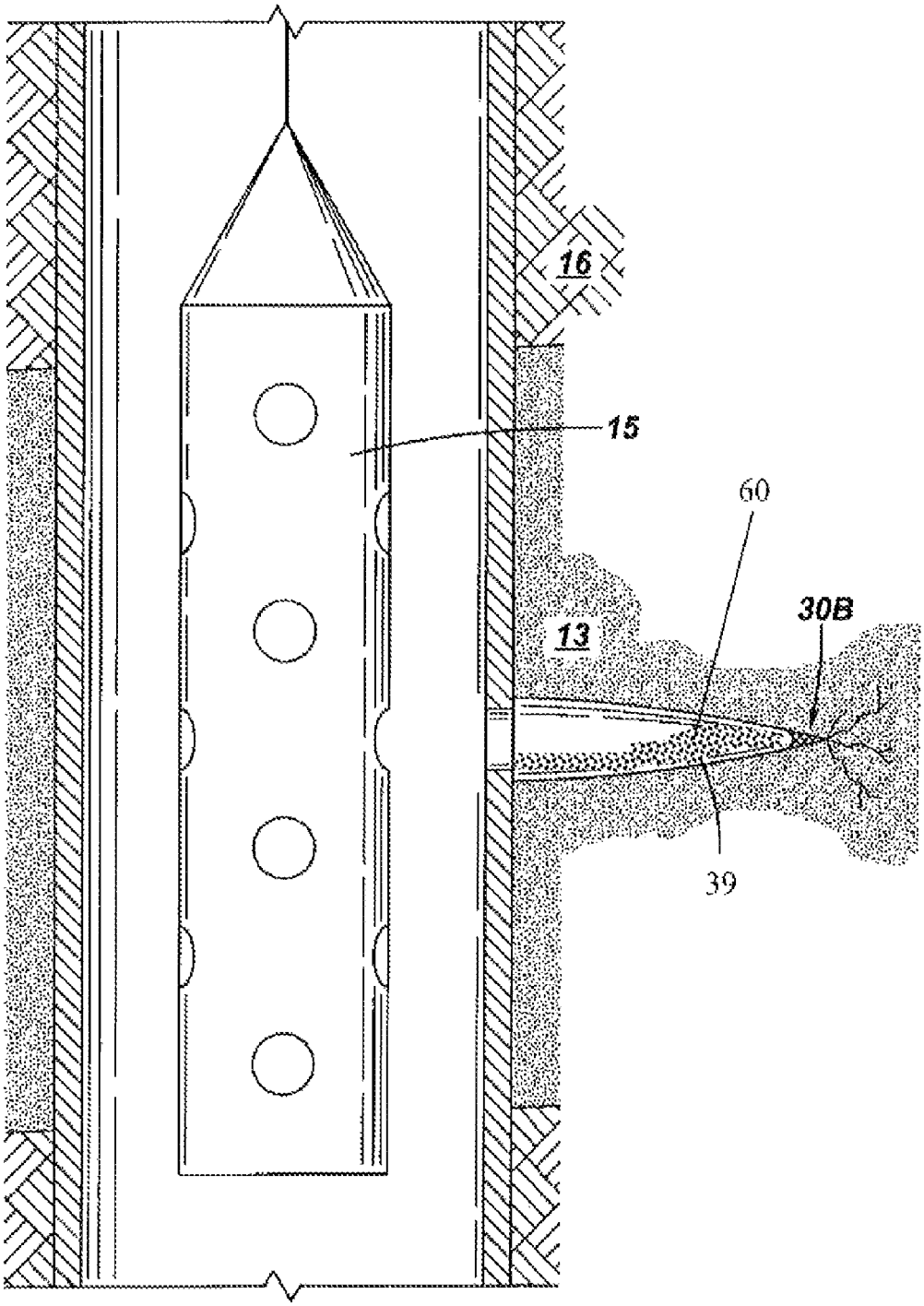
FIG. 6 shows a perforation and a tunnel made with a charge in accordance with embodiments of the invention.

As illustrated in FIG. 6, the undissolvable metal powders 60 (e.g., W powder) may remain in the tunnel after the dissolvable materials of the liner dissolves. However, these fine powders 60 would not cause any harmful effects because powders generally have good permeability for hydrocarbons and gases.

Embodiments of the invention relate to the use of dissolvable materials, which is dissolvable in a selected fluid, in all components of the shaped charges or perforation guns, such as cases, charge liners, encapsulated charges, and gun strings. The selected dissolving fluids may be originally present in the wellbore or formations or added from the surface. The following examples illustrate these embodiments in more detail.

EXAMPLES

Applications of Dissolvable Materials in Shaped Charge Cases

Some embodiments in accordance with the invention include introducing dissolvable materials in charge cases. After detonation, the debris or left over from the shaped charge cases would dissolve, leaving nothing inside the gun or wellbore. In accordance with other embodiments of the invention, high density materials (e.g., tungsten) may be added to the dissolvable materials such that the shaped charge cases can be used to enhance charge performances because more heavier (higher density) cases can hold pressure longer inside the charge cases and deliver more energy to the jet. If higher density cases are needed, high density materials, e.g., W (tungsten) powder, may be added to the dissolvable materials. In this case, the dissolvable materials would function as a bonding agent for the metal powders. After detonation, the dissolvable or bonding materials would dissolve and the additive materials, e.g., W powder, may remain in the form of fine powder. These fine powders would not cause any harmful effects because powders generally have good permeability.

Applications of Dissolvable Materials in Shaped Charge Liners

Some embodiments of the invention relate to use of dissolvable materials in the shaped charge liners. As noted above, these liners will dissolve in the tunnels and leave no harmful residues. By using dissolvable materials in the liner, the liner densities can be changed, the jet can be stretched better to increase casing entrance hole size or depth of penetration due to its specific properties under dynamic loading. In addition, the densities of the liners may be increased by adding high density materials, leading to better penetration ability. The additives may include high density metals, such as W powder. Although the left-over powders, e.g., W powder, are not dissolvable, they would not hinder production because powders generally have good permeability and could be flushed out from the tunnels if conditions allow.

Applications of Dissolvable Materials in the Encapsulated Charge

After detonation, almost all components of the encapsulated shaped charges would leave debris (from the cases, caps, and liners) in the wellbore. Some embodiments of the invention relate to the use of dissolvable materials in all components of encapsulated charges. All the benefits mentioned above in the un-capsulated shaped charges apply to the encapsulated charges.

Applications of Dissolvable Materials in All the Components as Heat Sources

Some embodiments of the invention relate to use of reactive dissolvable materials in shaped charge components, including the explosive pellets. These reactive materials may lead to reactions during and after detonation. The reactive dissolvable materials may quickly react with the explosives and affect the dynamic pressure behind the liners. The fast reaction rates may increase the energy of the jet stream. The dissolvable materials that can quickly react with the explosives may be nano-particles. The pressure generated inside the hollow carrier gun, the wellbore and/or, ultimately, the perforating tunnel can be affected depending on which components include reactive materials. Proper design may enhance charge performance and increase well productivity.

Applications of Dissolvable Materials in a Gun String as Safety Valves or Firing Valves Some embodiments of the invention relate to use of dissolvable materials as plug materials on a gun or firing head housing, which may be exposed to wellbore fluids. Once these dissolvable materials are exposed to the well bore fluids, e.g., hydrocarbons, water or drilling fluids, the plugs may begin to dissolve. As the plugs get thinner over time, after certain period of time (the time may be pre-determined depending on the kind of dissolvable materials used), the wellbore pressure may collapse the plugs. As a result, a communication between the gun or firing head housing and the wellbore may be established. The high pressure gases tapped inside the gun may be equalized with the pressure inside the wellbore. This pressure change may be used to fire the perforation gun string. Alternatively, the wellbore pressure may be used to actuate the firing head and shooting the whole gun strings. Thus, the firing head design could be simplified greatly.

Other embodiments of the present invention relate to systems for perforation. Referring to FIGS. 1 and 2, a perforation system in accordance with embodiments of the invention may include: (1) a perforation gun 15 (or gun string), wherein each gun may be a carrier gun (as shown) or an encapsulated gun (not shown); (2) one or more improved shaped charges 20 or encapsulated charges 30 loaded into the perforation gun 15 (or into each gun of the gun string); and (3) a conveyance mechanism 17 for deploying the perforation gun 15 (or gun string) into a wellbore 11 to align at least one of said shaped charges 20 or 30 within a target formation interval 13.

Each or most components in the system may be fabricated with materials that are soluble in selected fluids, as noted above. The selected dissolving fluids may be originally present in the wellbore or formations or added from the surface. In the above systems, the conveyance mechanism may be a wireline, slickline, tubing, or other conventional perforating deployment structure.

Figure 7:
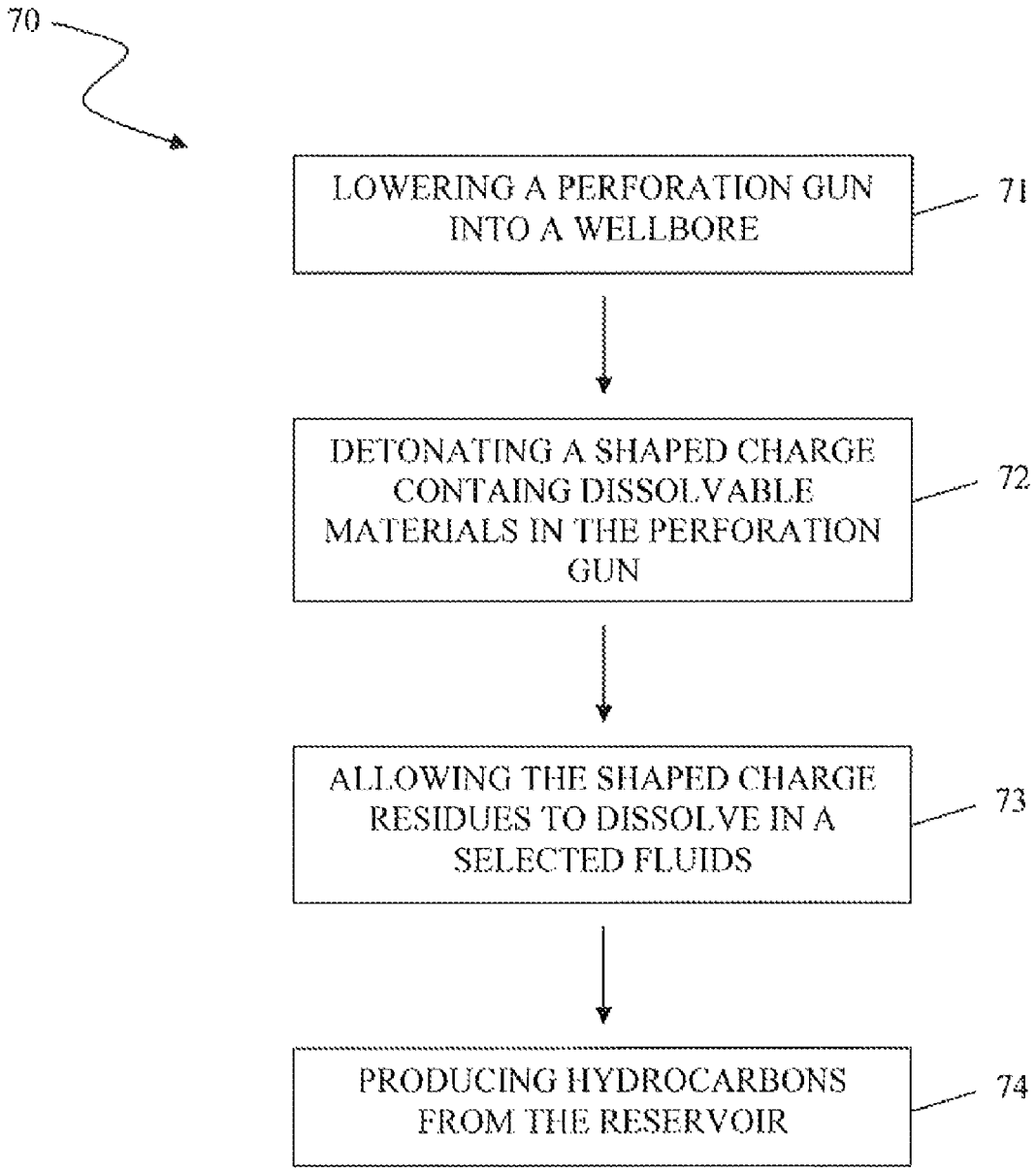
FIG. 7 shows a method of perforation in accordance with embodiments of the invention.

Some embodiments of the invention relate to methods for perforating a formation. For example, FIG. 7 illustrates a method 70 for perforating a formation from a wellbore. Such a method includes: (1) lowering a perforation gun into a well (step 71), wherein the perforation gun comprises one or more shaped charges or encapsulated charges. The perforation gun and/or the shaped charges may have some or all of the components made of dissolvable material(s); (2) detonating the shaped charge (step 72) to form a perforation tunnel in a formation zone; and (3) allowing the dissolvable materials of the shaped charge or perpetrating gun to dissolve (step 73). After such operation, treatment fluids may be injected into the formation and/or the formation may be produced for hydrocarbons (step 74).

Sometimes, for some reasons, the loaded gun string may need to stay down hole at high temperatures for a long period of time. This may exceed the duration indicated by the specification of the perforation guns. When this happens, the explosives may be partially or completely decomposed, resulting in high pressure inside the gun. Even if the gun strings were subsequently shot, the holes on the gun may be plugged causing high pressure gas to be trapped inside the gun. To prevent safety hazard, it would be desirable to release the high pressure gas trapped in the gun before bringing the gun back to surface. This may be achieved using dissolvable materials that will dissolve or degrade after a specified period of time.

Furthermore, in TCP (Tubing-Conveyed Perforating) completions, especially permanent completions, the gun strings may be fired at later times after they are rig into hole. For example, some TCP strings may travel long distance, e.g., >8,000 ft (2,440 m), and in highly deviated and horizontal wells. It would be desirable that the firing heads of the gun strings may be actuated and fired without any intervention at a specific time.

Figure 8:
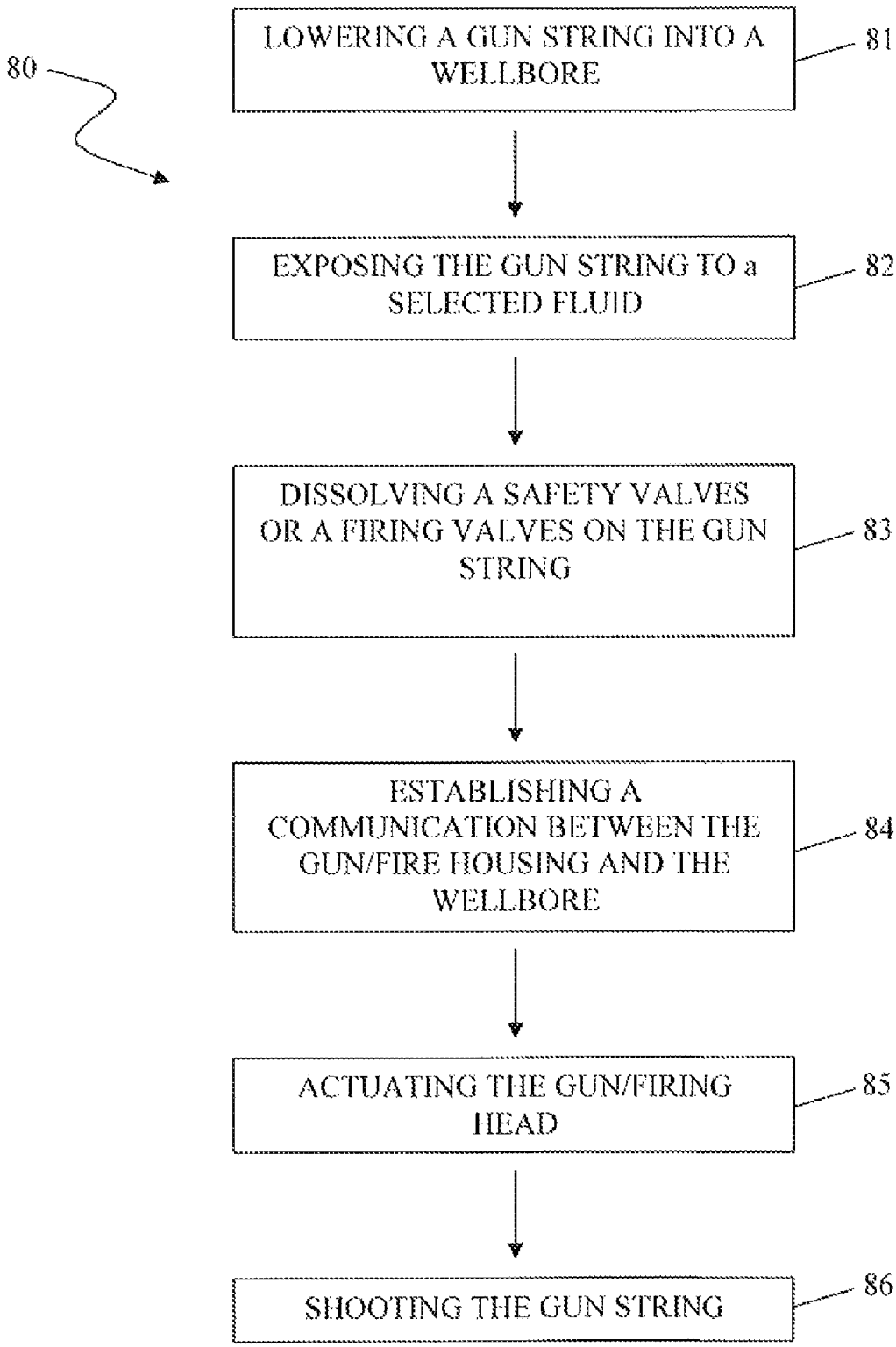
FIG. 8 shows a method of firing a gun string in accordance with embodiments of the invention.

FIG. 8 shows a method in accordance with one embodiment of the invention, The method 80 includes: (1) lowering into a wellbore a gun string, which may have safety valves or firing valves containing plugs made of dissolvable materials on a gun/firing head housing (step 81); (2) exposing the gun string to a selected fluid, e.g., water, acids, injection fluids, fracturing fluids, or completions fluids (step 82); (3) allowing a plug of at least one of the safety valves and the firing valves on the gun string to dissolve (step 83); (4) establishing a communication between the gun/firing head housing and the wellbore (step 84); (5) actuating the gun/firing head (step 85); and (6) shooting the gun string (step 86).

Advantages of embodiments of the invention may include one or more of the following. Apparatus and methods of the invention may generate bigger and deeper penetrating tunnels in a wellbore. The debris may be eliminated inside the guns, inside the wellbore and the perforating tunnels. The wellbore dynamic pressure may be manipulated. As a result, the well productivity may be significantly increased and the well completion engineering operation may be easy, e.g., no debris cleaning trip, no damaged packer, no clogged choke, etc.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method for perforating a formation, comprising:

lowering a perforating gun into a wellbore;

detonating a shaped charge in the perforation gun, wherein the shaped charge comprises:

a charge case, a liner:

an explosive retained between the charge case and the liner; and a primer core disposed in a hole in the charge case and in contact with the explosive, wherein at least one of the case, the liner, the primer core, and the explosive comprises a material soluble in a selected fluid, and wherein the liner comprises the material soluble in the selected fluid and a high density material.

2. The method of claim 1 wherein the perforating gun includes a plurality of shaped charges.

3. The method of claim 2 wherein the plurality of shaped charges are phased to fire in multiple directions from the perforating gun.

4. The method of claim 1 wherein the explosive is selected from the group consisting of cyclotrimethylenetrinitramine, hexahydro-1,3,5-trinitro-1,3,5-triazine, cyclotetramethylenetetranitramine, 1,3,5,7-tetranitro-1,3,5,7-tetraazacyclooctane, triaminotrinitrobenzene and hexanitrostilbene.

5. The method of claim 1 wherein the shaped charge further includes an O-Ring seal.

6. The method of claim 1 wherein the shaped charge further includes a crimping ring seal.

7. The method of claim 1 wherein the material soluble in the selected fluid comprises reactive non-particles reactive with the explosive upon detonation.

8. The method of claim 1 wherein the selected fluid includes water.

9. The method of claim 1 wherein the selected fluid is selected from the group consisting of hydrocarbons, water, water-based drilling fluids and hydrocarbon-based drilling fluids.

10. The method of 1 wherein the soluble material is a dissolvable material.

11. The method of claim 10 wherein the dissolvable material is a powdered metal.

12. The method of claim 11 wherein the powdered metal is selected from the group consisting of iron, magnesium, zinc, aluminum, alloys thereof and combinations thereof.

13. The method of claim 10 wherein the dissolvable material is selected from the group consisting of polyolefin polymers, paraffin waxes, polyalkylene oxides, polyalkylene glycols, polylactide ("PLA") polymer, polyglycolic acid; polycaprolactams, mixtures of PLA polymer and polyglycolic acid, sulfamic acid, trichloroacetic acid and citric acid.

14. The method of claim 10 wherein the dissolvable material degrades over a period of one hour to two hundred forty hours.

15. The method of claim 10 wherein the dissolvable material degrades over a period of one hour to forty eight hours.

16. The method of claim 10 wherein the dissolvable material degrades over a period of one hour to twenty four hours.

17. The method of claim 10 wherein the dissolvable material degrades over a temperature range of 50 C to 250 C.

18. The method of claim 10 wherein the dissolvable material degrades over a temperature range of 100 C to 250 C.

19. The method of claim 10 wherein the dissolvable material degrades over a temperature range of 150 C to 250 C.

* * * * *